US011635276B2

(12) United States Patent
Munsell

(10) Patent No.: US 11,635,276 B2
(45) Date of Patent: Apr. 25, 2023

(54) ARCHERY ARROW REST ORTHOGONAL CORD FORCE DEVICE

(71) Applicant: HAMSKEA ARCHERY SOLUTIONS LLC, Frederick, CO (US)

(72) Inventor: Andrew W. Munsell, Brighton, CO (US)

(73) Assignee: Hamskea Archery Solutions LLC, Frederick, CO (US)

( * ) Notice: Subject to any disclaimer, the term of this patent is extended or adjusted under 35 U.S.C. 154(b) by 68 days.

(21) Appl. No.: 17/448,053

(22) Filed: Sep. 19, 2021

(65) Prior Publication Data

US 2022/0113108 A1 Apr. 14, 2022

Related U.S. Application Data

(60) Provisional application No. 63/198,314, filed on Oct. 9, 2020.

(51) Int. Cl.
*F41B 5/22* (2006.01)
*F41B 5/14* (2006.01)

(52) U.S. Cl.
CPC ..... *F41B 5/143* (2013.01)

(58) Field of Classification Search
CPC ..... F41B 5/143
See application file for complete search history.

(56) References Cited

U.S. PATENT DOCUMENTS 3,504,659 A 4/1970 Fisher
4,287,868 A 9/1981 Schiff
4,452,528 A * 6/1984 Rath ..... G03B 27/525 396/548
4,476,846 A 10/1984 Carville
4,664,093 A 5/1987 Nunemaker
4,686,956 A 8/1987 Troncoso
4,827,895 A 5/1989 Troncoso
5,117,803 A 6/1992 Johnson
5,365,912 A * 11/1994 Pittman ..... F41B 5/143 124/44.5
5,386,814 A 2/1995 Denton
5,429,107 A 7/1995 Troncoso
5,490,491 A 2/1996 Troncoso
5,606,962 A 3/1997 Troncoso
(Continued)

OTHER PUBLICATIONS

"Mooring Springers Shock Absorbers 330mm×50mm Boat Marine Yacht" EBAY, printed from the Internet at https://www.ebay.com.au/itm/Mooring-Springers-Shock-Absorbers-330mm-x-50mm-Boat-Marine-Yacht on Sep. 30, 2020.

(Continued)

*Primary Examiner* — John A Ricci
(74) *Attorney, Agent, or Firm* — Trenner Law Firm, LLC; Mark D. Trenner

(57) ABSTRACT

An example archery arrow rest orthogonal cord force device for an arrow rest of an archery bow includes a housing member having a first end and a second end. A circuitous path is formed at least partly within the housing member. The circuitous path extends at least partly between the first end and the second end of the housing member. The housing member is attached along a linear axis of a cord defined by two attachment points of the cord in the arrow rest as part of the archery bow.

20 Claims, 22 Drawing Sheets

(56) References Cited

U.S. PATENT DOCUMENTS

| | | | | |
|---|---|---|---|---|
| 5,632,263 | A | 5/1997 | Sartain | |
| 5,678,530 | A | 10/1997 | Van Drielen | |
| 5,722,381 | A | 3/1998 | Mizek | |
| 5,960,779 | A | 10/1999 | Jessee et al. | |
| 6,044,832 | A | 4/2000 | Pierson, Jr. | |
| 6,089,216 | A | 7/2000 | Harwath et al. | |
| 6,178,959 | B1 | 1/2001 | Troncoso, Jr. et al. | |
| 6,202,635 | B1 | 3/2001 | Evans | |
| 6,334,349 | B1 | 1/2002 | Rolf | |
| 6,363,924 | B1 | 4/2002 | Adams | |
| 6,591,823 | B1 | 7/2003 | Keller | |
| 6,595,195 | B1 | 7/2003 | Barner et al. | |
| 6,615,813 | B1 | 9/2003 | Troncoso | |
| 6,634,349 | B2 | 10/2003 | Mizek | |
| 6,732,395 | B2 | 5/2004 | Gringer | |
| 6,915,791 | B2 | 7/2005 | Harwath | |
| 7,219,662 | B1 * | 5/2007 | Henry | F41B 5/143 124/44.5 |
| 7,331,338 | B2 | 2/2008 | Mizek | |
| 7,409,950 | B2 | 8/2008 | Ellig | |
| 7,681,566 | B2 | 3/2010 | Mertens | |
| 7,717,103 | B2 | 5/2010 | Johnson | |
| 7,975,391 | B1 | 7/2011 | Gillingham et al. | |
| 8,333,180 | B2 | 12/2012 | Mizek | |
| 8,342,161 | B2 | 1/2013 | Harwath et al. | |
| 8,544,457 | B1 | 10/2013 | Munsell et al. | |
| 8,752,536 | B2 | 6/2014 | Sims | |
| 8,875,687 | B1 | 11/2014 | Huang | |
| 9,341,433 | B1 | 5/2016 | Summers et al. | |
| 9,746,277 | B2 * | 8/2017 | Khoshnood | F41B 5/1403 |
| 9,816,776 | B2 * | 11/2017 | Ellig | F41B 5/143 |
| 9,829,270 | B2 | 11/2017 | Summers | |
| 9,933,229 | B2 | 4/2018 | Coalson et al. | |
| 10,012,473 | B2 | 7/2018 | Munsell et al. | |
| 10,746,499 | B2 | 8/2020 | Munsell | |
| 2006/0162709 | A1 * | 7/2006 | Roberts | F41B 5/143 124/44.5 |
| 2008/0236556 | A1 | 10/2008 | Sims | |

OTHER PUBLICATIONS

"PT-100 Fall-Away Arrow Rest", SVL SIMS Vibration Laboratory, printed from the Internet at https://limbsaver.com/products/pt-100-fall-away-arrow-rest on Aug. 31, 2021.

"Arc Systeme Arrow Rest Compound Mono 2019" JVD Archery, printed from the Internet at https://www.jvd-archery.com/products/116775 on Aug. 31, 2021.

"Mooring Snubber, fits 7/16"-5/8" line" OVERTON'S, printed from the Internet at https://www.overtons.com/mooring-snubber-fits-716---58-line-315700.html?utm_source=google&utm_medium=ppc&utm_campaign=%7bCampaign%7d&gclid=CjwKCAjw9uKlBhA8EiwAYPUS3DuaVvAQEzcxFHqna36EeUoLgS-BCHE6xGBDEGwzunedlz1OMhpq9hoCTuYQAvD_BwE&gclsrc=aw.d on Aug. 31, 2021.

"Boat Rubber Mooring Snubber 5/8-13/16 In. Rope FO-4435 Five Oceans" FiveOceans, printed from the Internet at https://www.five-oceans.com/products/boat-rubber-mooring-snubber-58-1316-in-rope-fo-4435 on Aug. 31, 2021.

* cited by examiner

ARCHERY ARROW REST ORTHOGONAL CORD FORCE DEVICE

PRIORITY CLAIM

This application claims the priority filing benefit of U.S. Provisional Patent Application No. 63/198,314 filed Oct. 9, 2020 for "Archery Arrow Rest Orthogonal Cord Force Device" of Andrew W. Munsell, hereby incorporated herein by reference in its entirety as though full set forth herein.

BACKGROUND

Since the advent of the drop-away rest, there have been many designs and variants on the theme. There are two major categories of mechanical arrow rests: 1) the fall-away, and 2) the limb actuated. Each type makes use of a cord that attaches to the rotating shaft of an arrow rest by lever arm, and to a moving member of the bow (e.g., limb, buss cable, cam yolk system, etc.).

The limb actuated rest makes use of the moving member of the bow (e.g., limb, buss cable, cam yolk system, cable guard slides or rollers, etc.) of the bow to apply force through the attachment cord that pulls down the launcher assembly, rotating the launcher down and out of the way of the projectile arrow when bow is fired. This is the opposite of the fall-away rest, in that the spring tension of the torsion spring applied to the rotating shaft lifts the attached launcher to the "up" position opposed to keeping it in the "down" position.

In each instance, the cord serves as a critical element in the bow-arrow rest system for tethering the mechanical rest to a dynamic member of the bow to activate the mechanism of the rest. The ultimate goal of any mechanized arrow rest is to move the arrow rest launcher out of the path of the arrow projectile to minimize interference between the two elements, resulting in efficient and accurate arrow flight.

There are two approaches in forcing the arrow rest launcher down and out of the way of the traveling arrow projectile. The "fall-away" (also referred to as the "drop-away") arrow rest implements torsional spring tension applied to the rotating shaft of the arrow rest, which forces the attached arrow launcher to rotate down and out of the way of the projectile arrow proportional to the torsion spring rate. Once the launcher has completed its rotational range, the torsion spring keeps the launcher in the down position. To overcome this torsional spring force, a cord on the launcher/rotating shaft assembly of the arrow rest is commonly attached to the buss cable and/or associated components of the compound bow. When the bow is drawn, the buss cable moves in a downward direction, pulling on the cord, which overcomes the torsion spring and rotates the launcher assembly of the arrow rest to hold the launcher assembly in the UP position. When the bow is fired, the buss cable returns to its resting position, relieving the force on the torsion spring and enabling the torsion spring to rotate and drive the launcher to its resting or "down" position.

Current techniques in an arrow rest cord implement coiled springs to apply either torsional resistance to the cord or axial/linear resistance to the cord. By doing so, the effective cord length changes as a function of the spring's ability to wind, compress or stretch as the spring force is applied in the axial dimension of the cord.

As with any spring, if the spring is over-extended or held in compression (torsionally wound or linearly) for extended periods of time, the coil can fail, resulting in limited to no spring force or yield (i.e. reduced spring rate), resulting in inconsistent effective cord length elongation which impact the consistency of the system. In the bowhunting environment, if the cord is caught on any external debris, the attached spring can be over stretched as described, rendering the arrow rest system and archery bow system inoperable and resulting in the failure to be able to activate the arrow rest mechanism as part of launching the projectile arrow.

DETAILED DESCRIPTION

Figure 1:
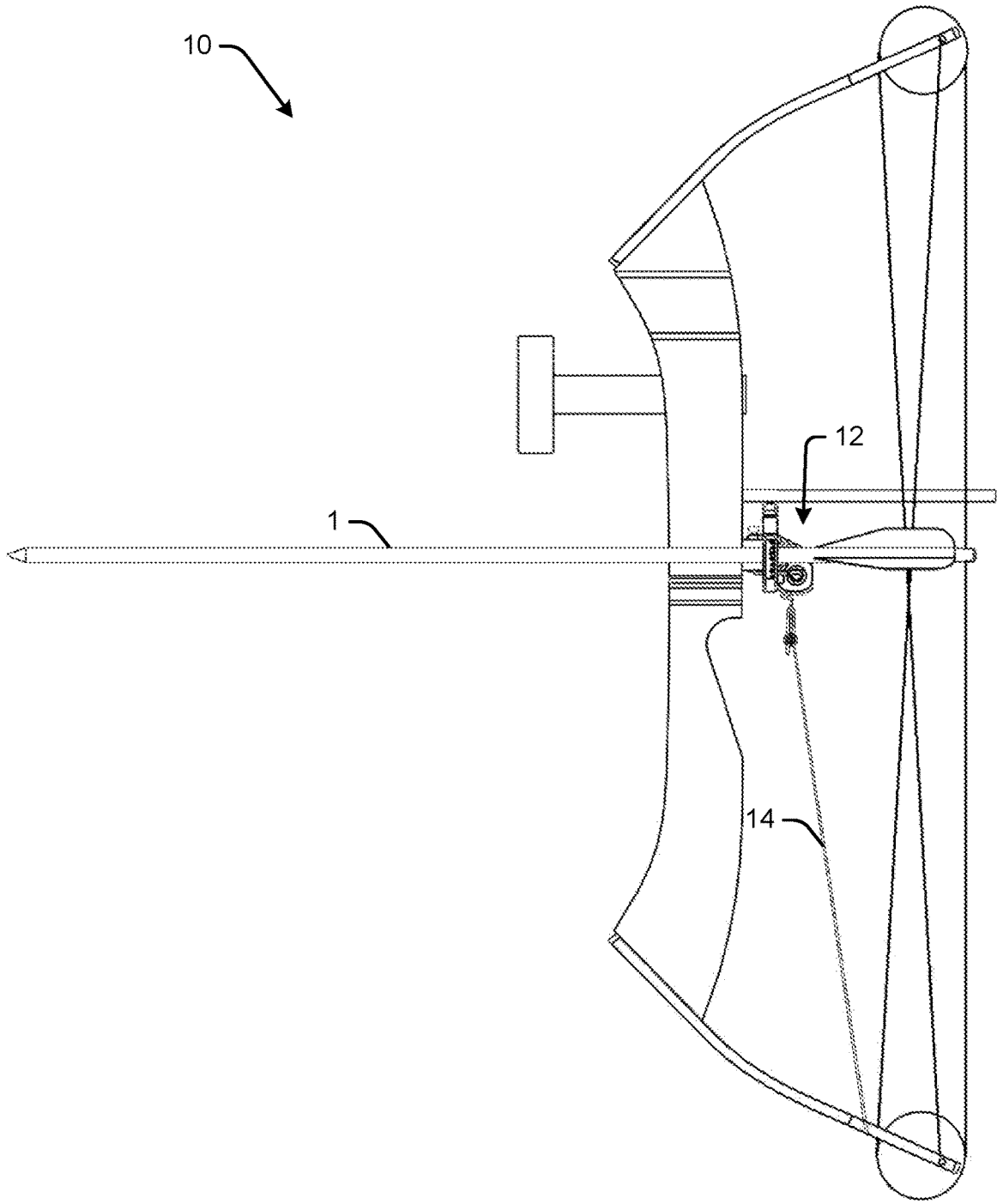
FIG. 1 shows an example bow system at static or rest.

An archery arrow rest orthogonal cord force device is disclosed herein as it may be implemented to apply a resistance force orthogonal to the linear axis of the effective cord length defined by the two attachment points of the cord in the arrow rest system and the archery bow system.

An example of the archery arrow rest orthogonal cord force device includes a housing member having a first end and a second end. A circuitous path is formed at least partly within the housing member. The circuitous path extends at least partly between the first end and the second end of the housing member. In an example, at least one wall is formed in the housing member. The wall(s) form a portion of the circuitous path. In an example, at least one opening is formed through a portion of the housing member. The opening(s) form a portion of the circuitous path. In an example, the housing member is attached along a linear axis of a cord defined by two attachment points of the cord in the arrow rest as part of the archery bow.

The archery arrow rest orthogonal cord force device effectively provides resistance to the cord, increasing length in the linear/axial direction of the cord in an arrow rest system and, when over-extended, returns back to its original dimensions and spring effectiveness as orthogonally applied to the cord. The archery arrow rest orthogonal cord force device eliminates the need for a conventional spring (e.g., coiled, leaf, etc.), and provides a more robust effective resistance to an arrow rest cord when being lengthened.

In an example, an archery arrow rest orthogonal cord force device provides a force on a minimum of one section of the arrow rest cord in an orthogonal direction to the cord's linear axis as defined by the two mounting points of the cord in an archery bow system. These two points are most commonly the arrow rest rotating shaft with assembly lever arm and the bow element inclusive but not limited to the bow limb, buss cable, or assemblies or sub-assemblies thereof (e.g., harnessing, yokes, and components thereof, buss cable guard with rotational, rolling, or slidable buss cable guides, etc.). This applied force imparted on the cord as part of the arrow rest system in an archery bow system.

In an example, the material itself (e.g., elastic in nature) imparts an orthogonal force to the cord as the cord is weaved through an elastomeric medium when the cord is under extreme tension by the two end points of the cord in an archery bow system when launching a projectile arrow.

Before continuing, it is noted that as used herein, the terms "includes" and "including" mean, but is not limited to, "includes" or "including" and "includes at least" or "including at least." The term "based on" means "based on" and "based at least in part on."

It is also noted that the examples described herein are provided for purposes of illustration, and are not intended to be limiting. Other devices and/or device configurations may be utilized to carry out the operations described herein.

The operations shown and described herein are provided to illustrate example implementations. It is noted that the operations are not limited to the ordering shown. Still other operations may also be implemented.

Figure 2:
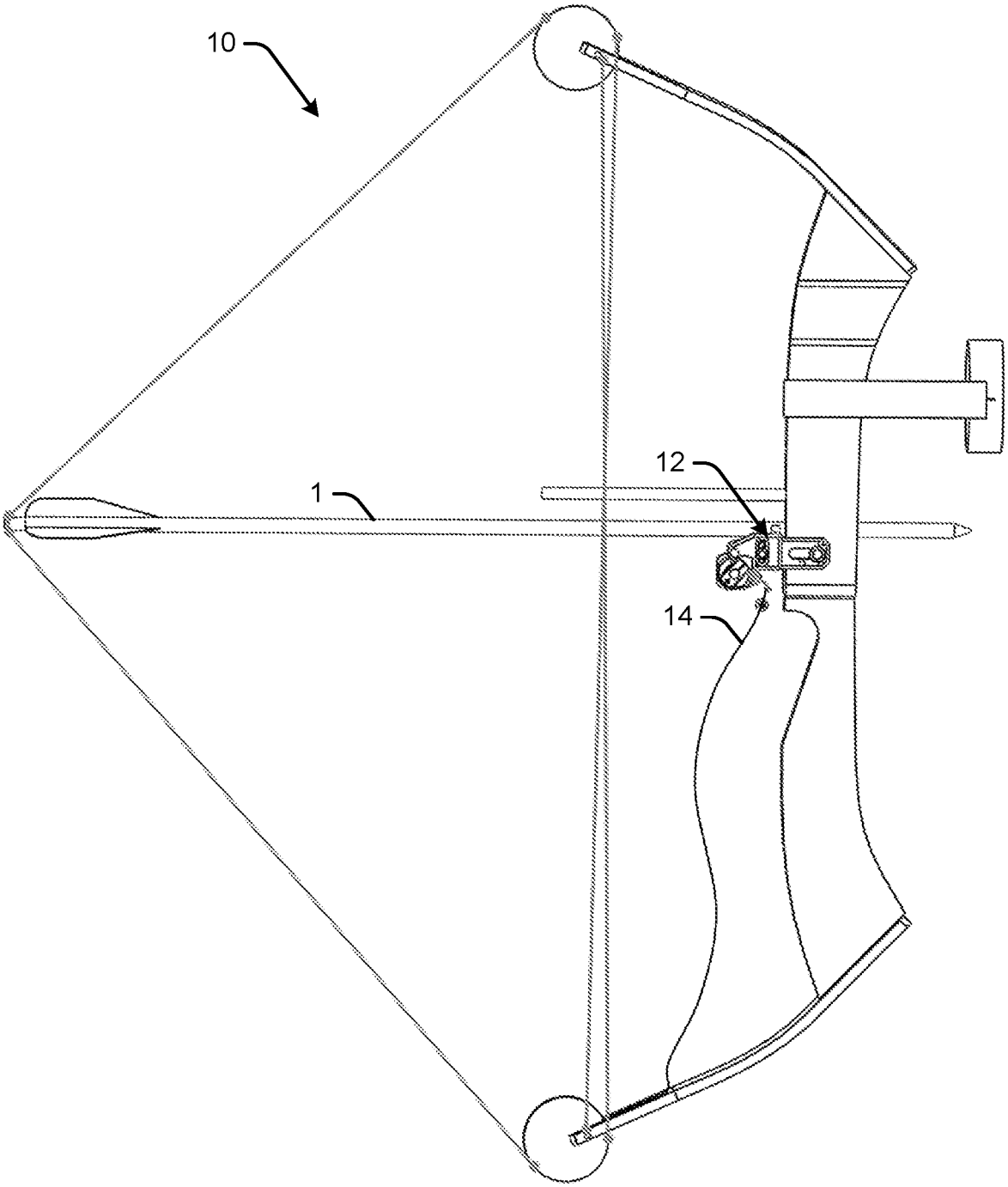
FIG. 2 shows the bow system shown in FIG. 1 at full draw.
Figure 3:
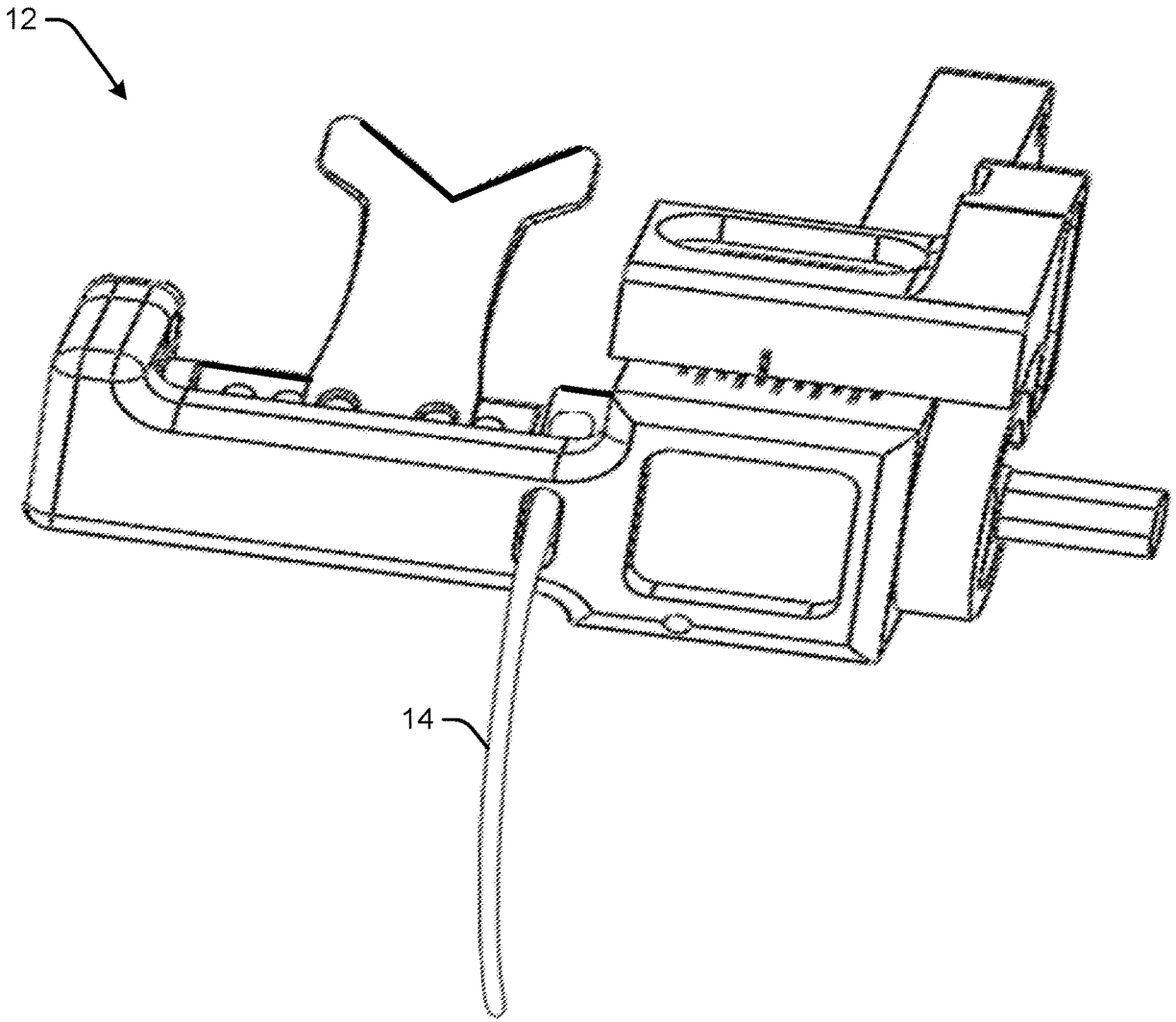
FIG. 3 is a perspective view of an example arrow rest configured as a fall-away arrow rest.
Figure 4:
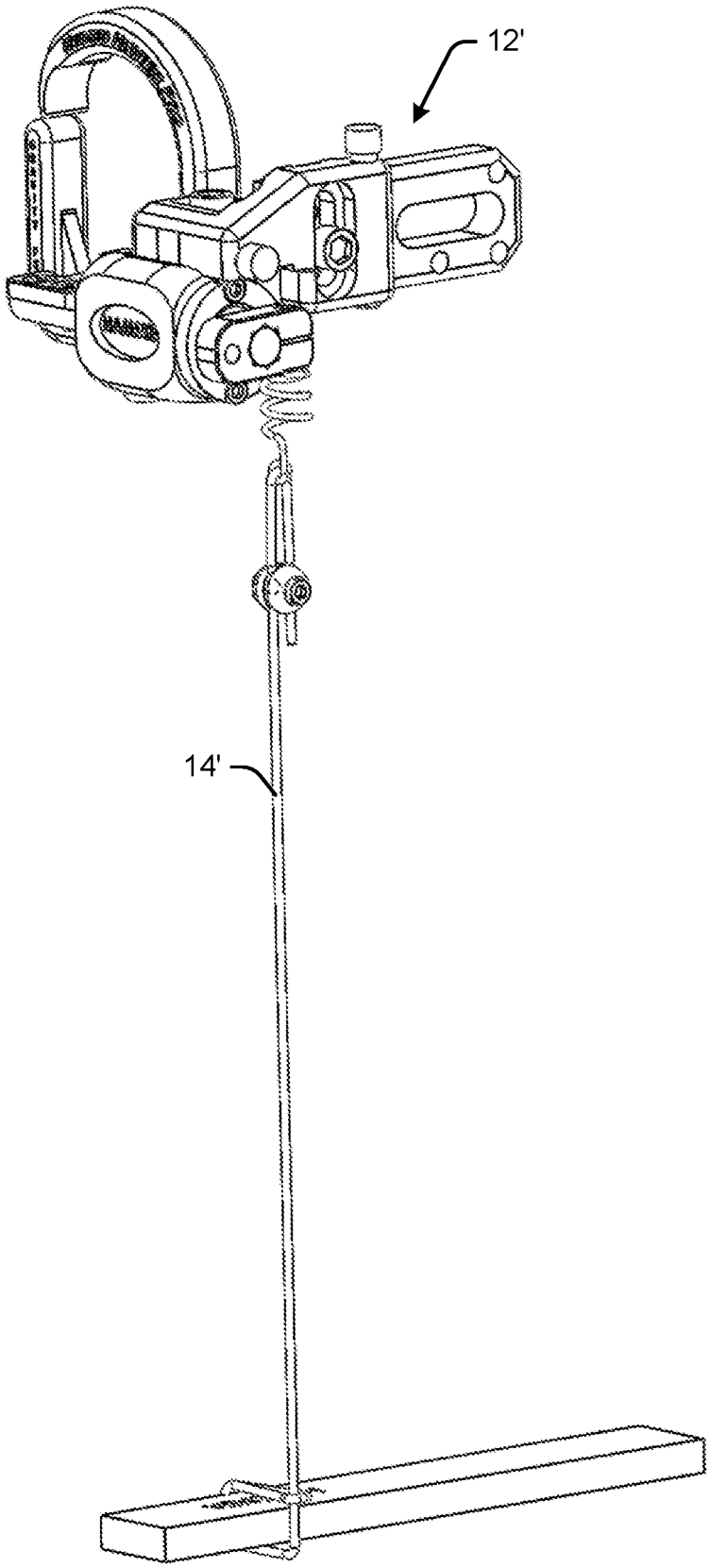
FIGS. 4-5 show an example arrow rest configured as a limb actuated arrow rest in a bow system at rest with the in-line spring.
Figure 5:
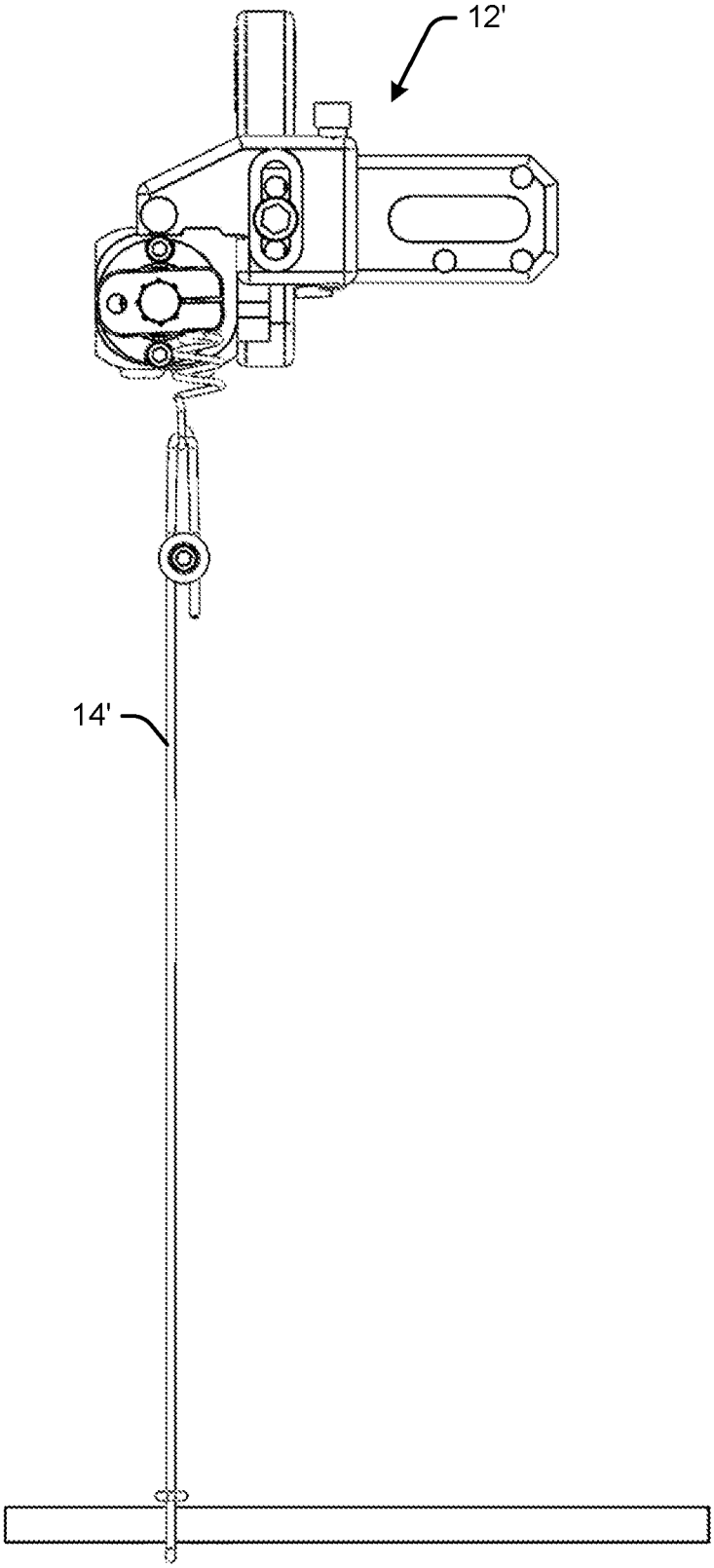
Figure 6:
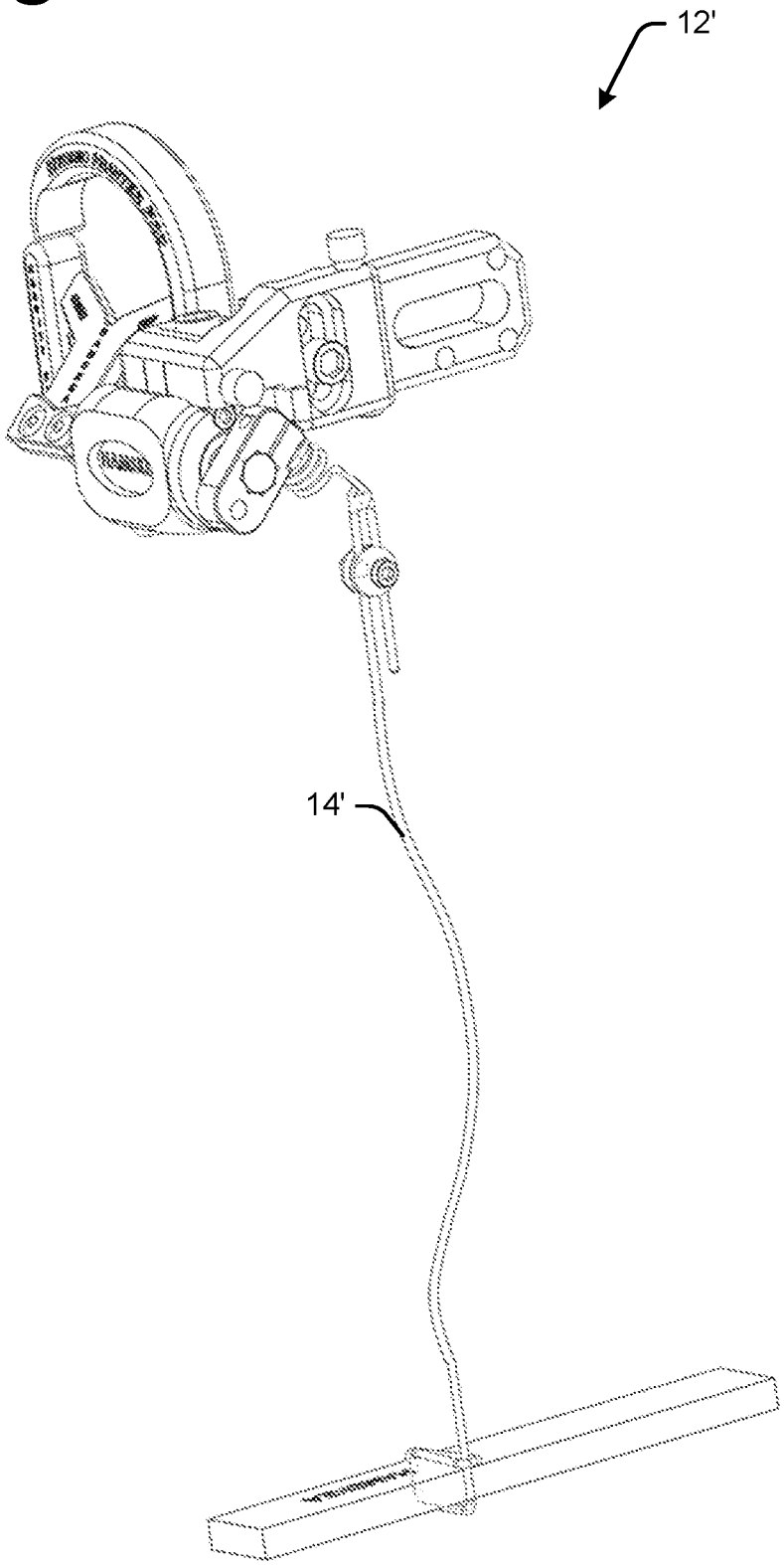
FIGS. 6-7 show an example limb actuated configured arrow rest in bow system at full draw.
Figure 7:
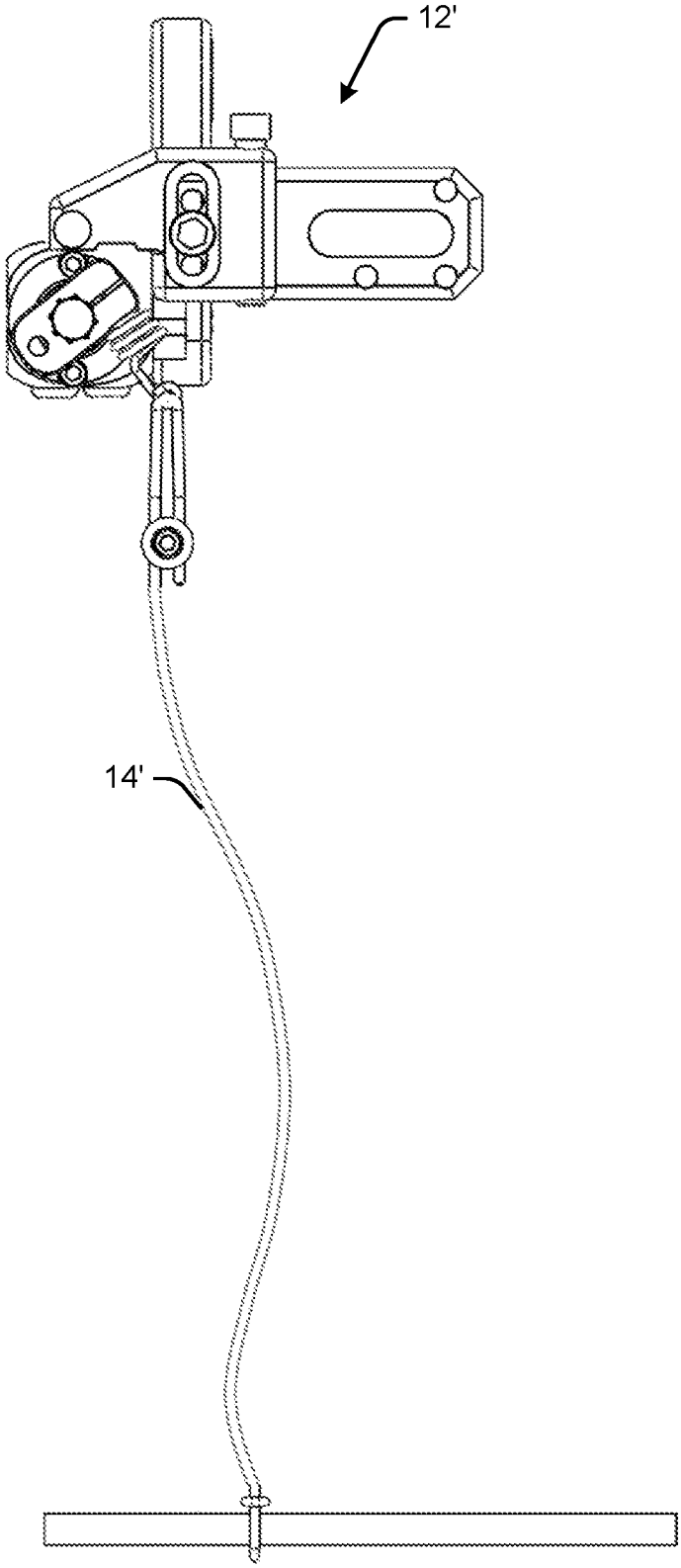

FIG. 1 shows an example bow system 10 with an arrow 1 at static or rest for a limb actuated rest. FIG. 2 shows the bow system 10 shown in FIG. 1 with the arrow 1 at full draw for a limb actuated rest. FIG. 3 is a perspective view of an example arrow rest 12 configured with a cord 14 as a fall-away arrow rest. FIGS. 4-5 show an example arrow rest 12' configured with the cord 14' as a limb actuated arrow rest in a bow system at rest. This is the spring/coil that can fail when/if the cord is snagged on something and over-stretches the coil as described above. FIGS. 6-7 show the example arrow rest 12' of FIGS. 4-5 configured as a limb actuated arrow rest with the cord 14' at full draw.

In the limb actuated rest 12', the cord 14' is attached to the rotating shaft, usually to a lever arm attached to the shaft wherein the launcher is mounted and the bow limb. In this position, the limb tension overcomes the rotating shaft torsional spring tension, keeping the launcher in the "down" position when the bow assembly is at rest. When the bow is drawn, the distance between the limbs decreases as the limbs move toward each other in the bow system to store the draw force energy. This physical movement of the limb relieves the force of the limb from the spring of the rotating shaft torsion spring and rotates the launcher and the arrow resting on top of it to the "up" position. When the bow is fired, the limb returns to its resting position, which pulls on the cord, rotating the shaft and attached launcher to the "down" position by overcoming the torsion spring force.

These two types of mechanical arrow rests are described as one of two types: a fall-away 12 (torsion spring rotates the arrow rest shaft assembly to the "down" position) or a limb actuated 12' (torsion spring rotates the launcher to the "up" position) arrow rest. In both types of arrow rests 12 and 12', the cord 14 and 14', if allowed to change length and return to its original or static dimension, provides additional advantages by increasing arrow guidance, reducing the launcher bounce back/rebound, and reducing the forces imparted on the rest by the sudden stop of the rotating shaft with the arrow launcher attached.

The example orthogonal cord force device disclosed herein may be implemented with either or both of the two types of mechanical arrow rests 12 and 12', and may also be implemented with other arrow rests now known or later developed, as will be readily understood by those having ordinary skill in the art after becoming familiar with the teachings herein.

Figure 8:
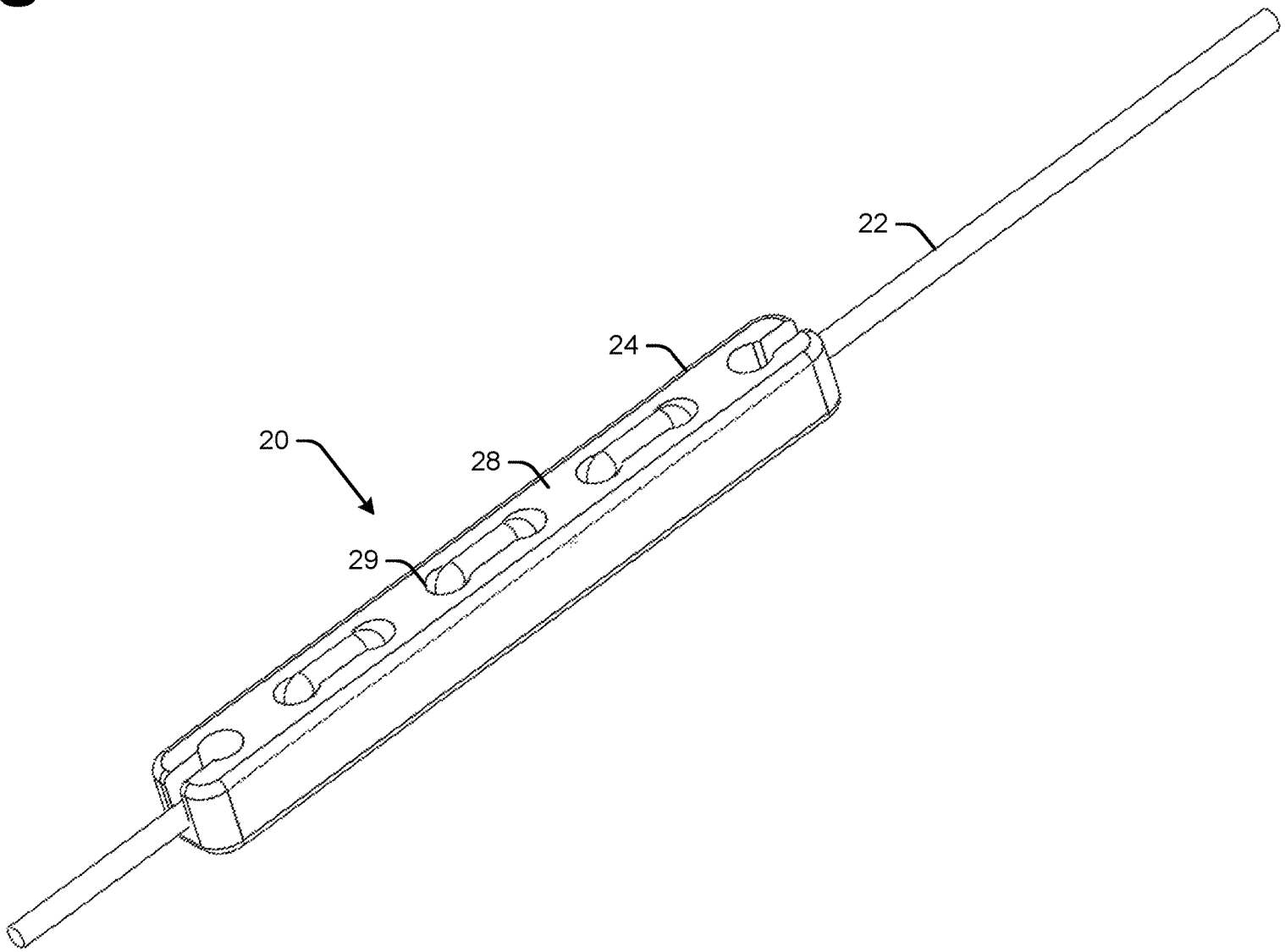
FIG. 8 shows an example orthogonal cord force device, limb actuated configuration in a bow system at full draw, with the cord not under tension.
Figure 9:
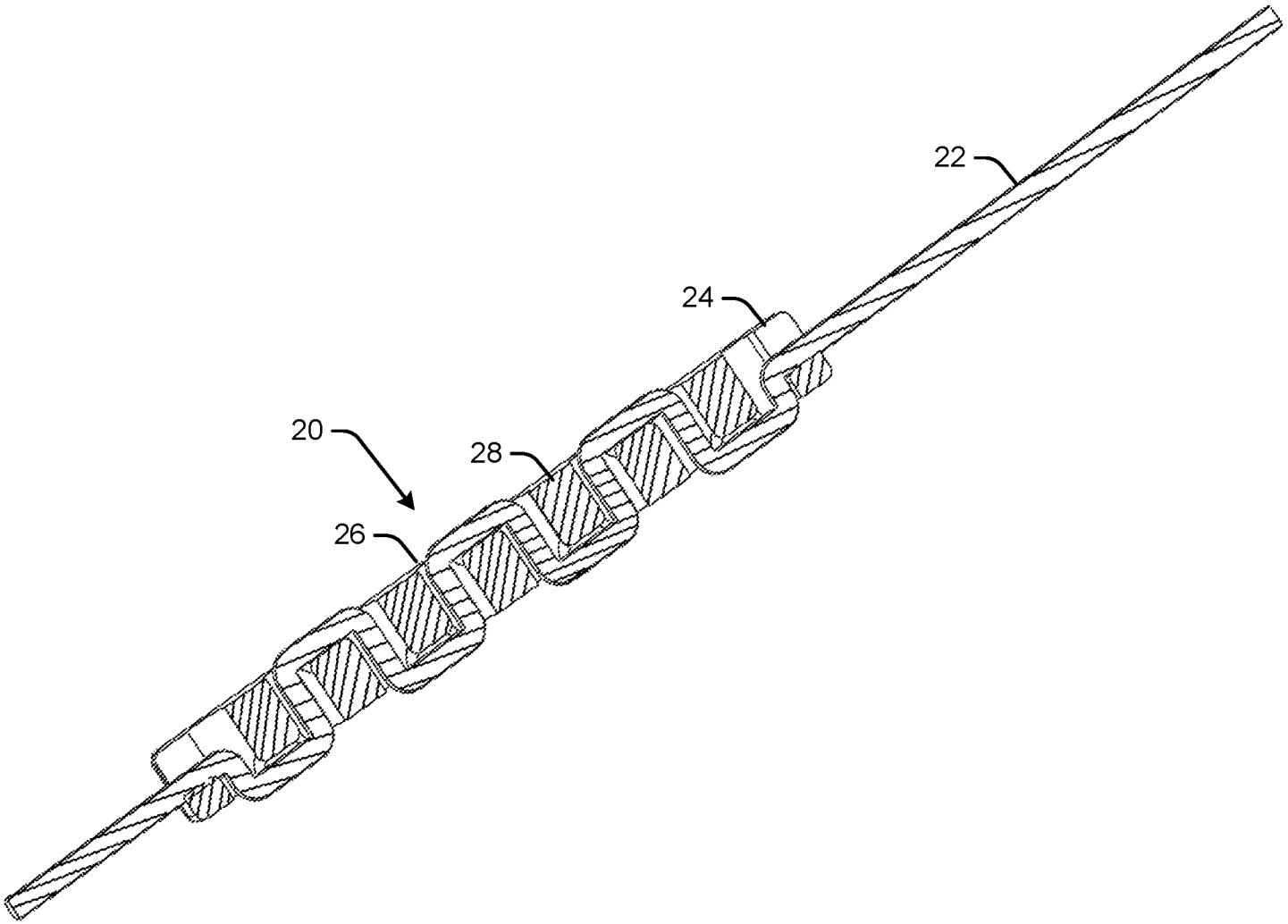
FIG. 9 is a cross sectional view of the example orthogonal cord force device corresponding to FIG. 8.

FIG. 8 shows an example orthogonal cord force device 20 for a mechanical arrow rest (e.g., 12 or 12' in FIGS. 1-7) in a bow system (e.g., 10 in FIGS. 1-2). In FIG. 8, the bow system is at full draw, and the cord 22 (e.g., cord 14 or 14' in FIGS. 1-7) is not under tension. FIG. 9 is a cross sectional view of the example orthogonal cord force device 20 corresponding to FIG. 8.

The example archery arrow rest orthogonal cord force device 20 for an arrow rest of an archery bow includes a housing member 24 having a first end and a second end. The example archery arrow rest orthogonal cord force device 20 includes a circuitous path 26 formed at least partly within the housing member 24. The circuitous path 26 extends at least partly between the first end and the second end of the housing member 24. In an example, the housing member 24 is attached along a linear axis of a cord 22 defined by two attachment points of the cord 22 in the arrow rest as part of the archery bow.

In an example, at least one wall 28 is provided in the housing member 24. The wall(s) 28 form a portion of the circuitous path 26. At least one opening 29 is provided through a portion of the housing member 24. In an example, the opening(s) 29 form a portion of the circuitous path 26.

In an example, the housing member 24 provides a resistance when the cord 22 is under tension. The circuitous path 26 increases a length in a linear axial direction of the cord 22 in the arrow rest.

In an example, at least one dimension (e.g., length, width) of the housing member 24 changes when the cord 22 is under tension. The dimension(s) of the housing member 24 change under tension, then return back to an original value when the tension on the cord 22 is relieved, and the spring effectiveness of the cord 22 decreases when the tension on the cord 22 is relieved.

Figure 10:
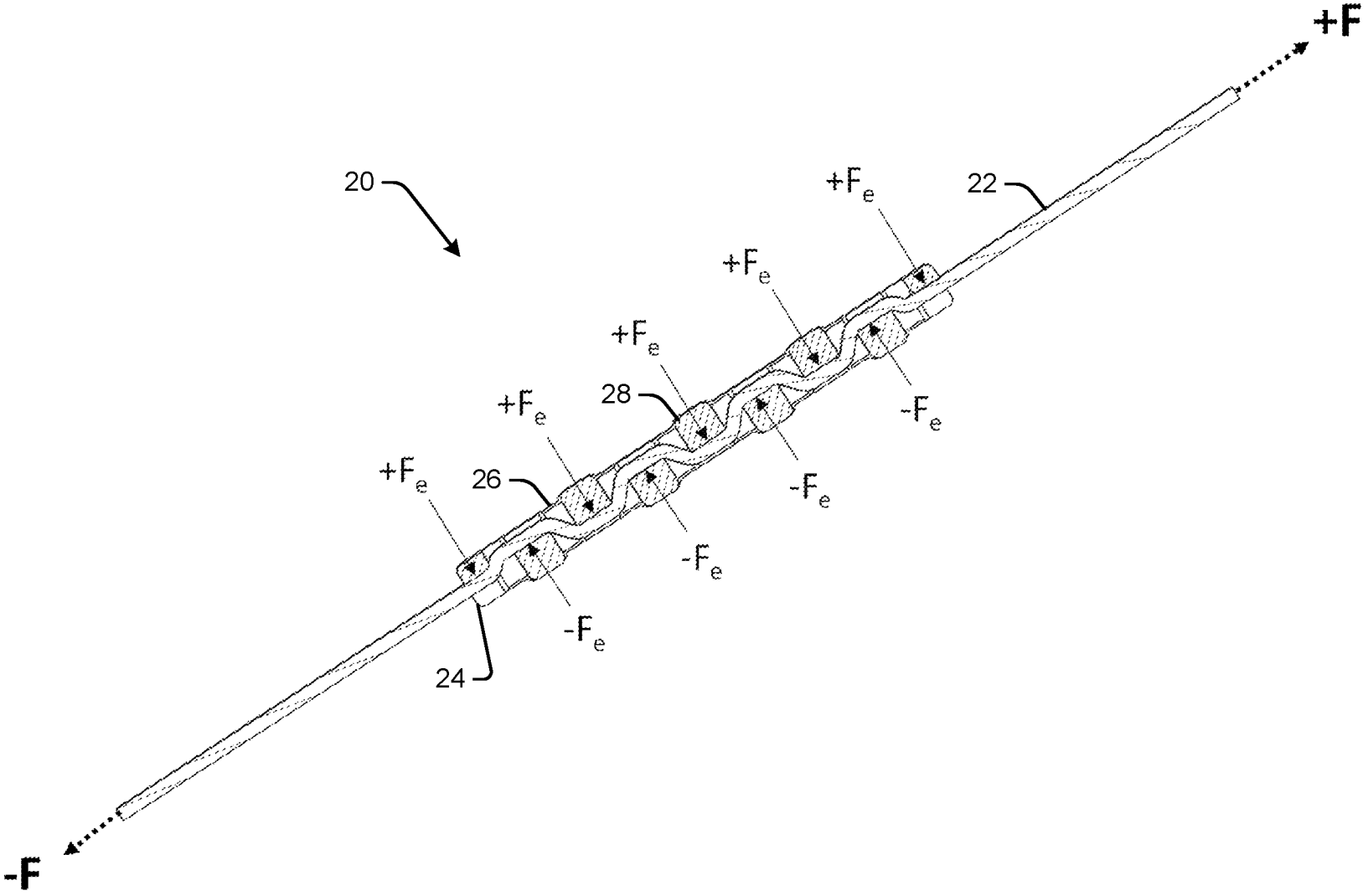
FIG. 10 illustrates forces on the cord of the example orthogonal cord force device, limb actuated configuration in a bow system at rest, when the cord is under tension.
Figure 11:
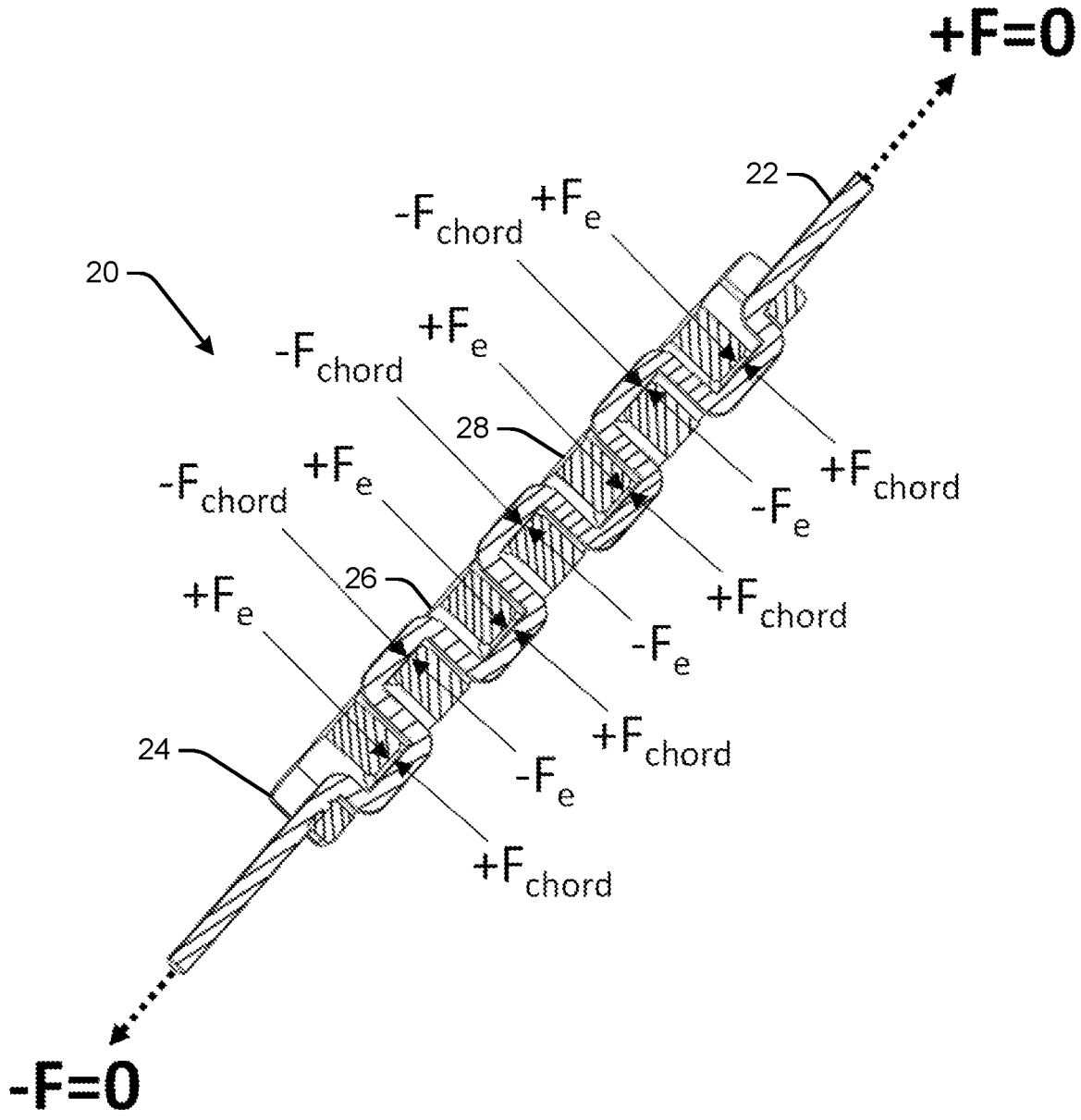
FIG. 11 illustrates forces on the cord of the example orthogonal cord force device corresponding to FIG. 10, when the cord is not under tension.
Figure 12:
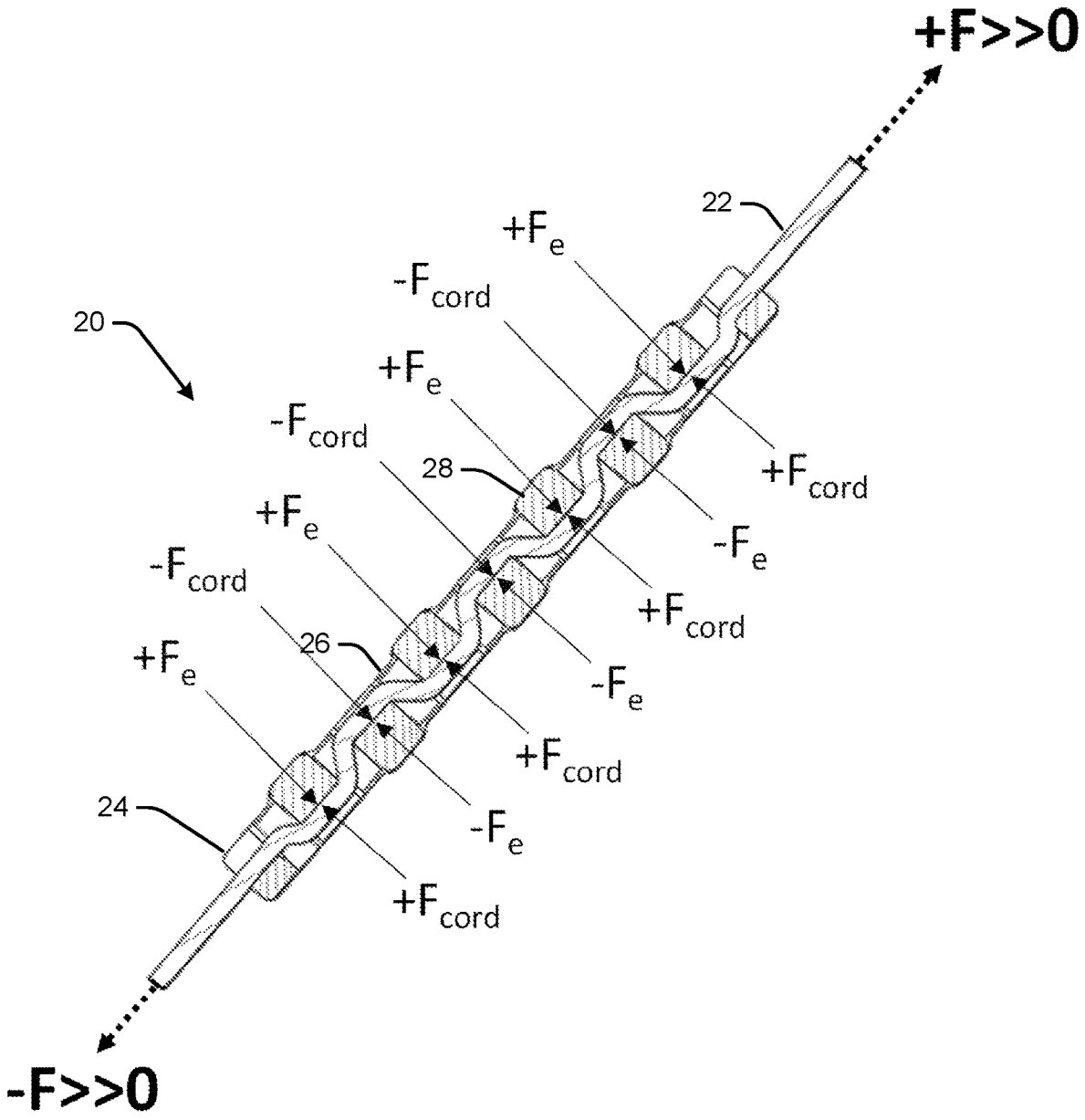
FIG. 12 illustrates forces on the cord of the example orthogonal cord force device, limb actuated configuration in a bow system at rest, when the cord is under tension.

FIG. 10 illustrates forces on the cord 22 of the example orthogonal cord force device 20 when the cord 22 is under tension. FIG. 11 illustrates forces on the cord 22 of the example orthogonal cord force device 20 corresponding to FIG. 10, when the cord 22 is not under tension. FIG. 12 illustrates forces on the cord 22 of the example orthogonal cord force device 20 in a static state, when the cord 22 is under tension.

In an example, the archery arrow rest orthogonal cord force device 20 imparts equal and opposite forces on the cord 22 that is weaved through the multiple sections of the device 20 as the cord 22 is put in linear/axial tension between the two opposite mounting ends. The condition for the cord 22 under tension is caused when the bow system launches the projectile arrow and the cord 22 goes from a relaxed state (e.g., F=0) to a tension state (e.g., ±F>0). It is noted that this only applies to a limb actuated rest, and is the opposite for a fall-away rest. However, the device described herein can also be used with a fall-away rest.

In an example, cord tension (+F, −F) is defined as a linear force exerted between two attachment points of the cord 22. An elastomeric force (+Fe, −Fe) on the cord 22 increases as the cord tension (+F, −F) increases. The elastomeric force (+Fe, −Fe) applies an orthogonal counter force to the cord 22 when the cord 22 is under tension.

In an example, the cord tension +F is a linear force imparted by a first attachment point to an arrow rest lever arm. The cord tension −F is a linear force imparted by a second attachment point to a bow member.

In an example, the elastomeric force (+Fe, −Fe) is applied orthogonally to the cord 22 along an axis defined by end points of the cord 22. The elastomeric force (+Fe, −Fe) varies as a function of force applied to the cord 22.

In an example, the elastomeric force (+Fe, −Fe) is about zero when there is no force on the cord (+Fchord, −Fchord).

In an example, the elastomeric force (+Fe, −Fe) is substantially equal to the force on the cord (+Fchord, −Fchord) at all times. In an example, the elastomeric force (+Fe, −Fe) is substantially proportional to the force on the cord (+Fchord, −Fchord) at all times.

In an example, increasing the force on the cord (+Fchord, −Fchord) straightens the cord. In an example, increasing the force on the cord (+Fchord, −Fchord) increases the cord length. In an example, decreasing the force on the cord (+Fchord, −Fchord) decreases the length of the cord 22.

Figure 13:
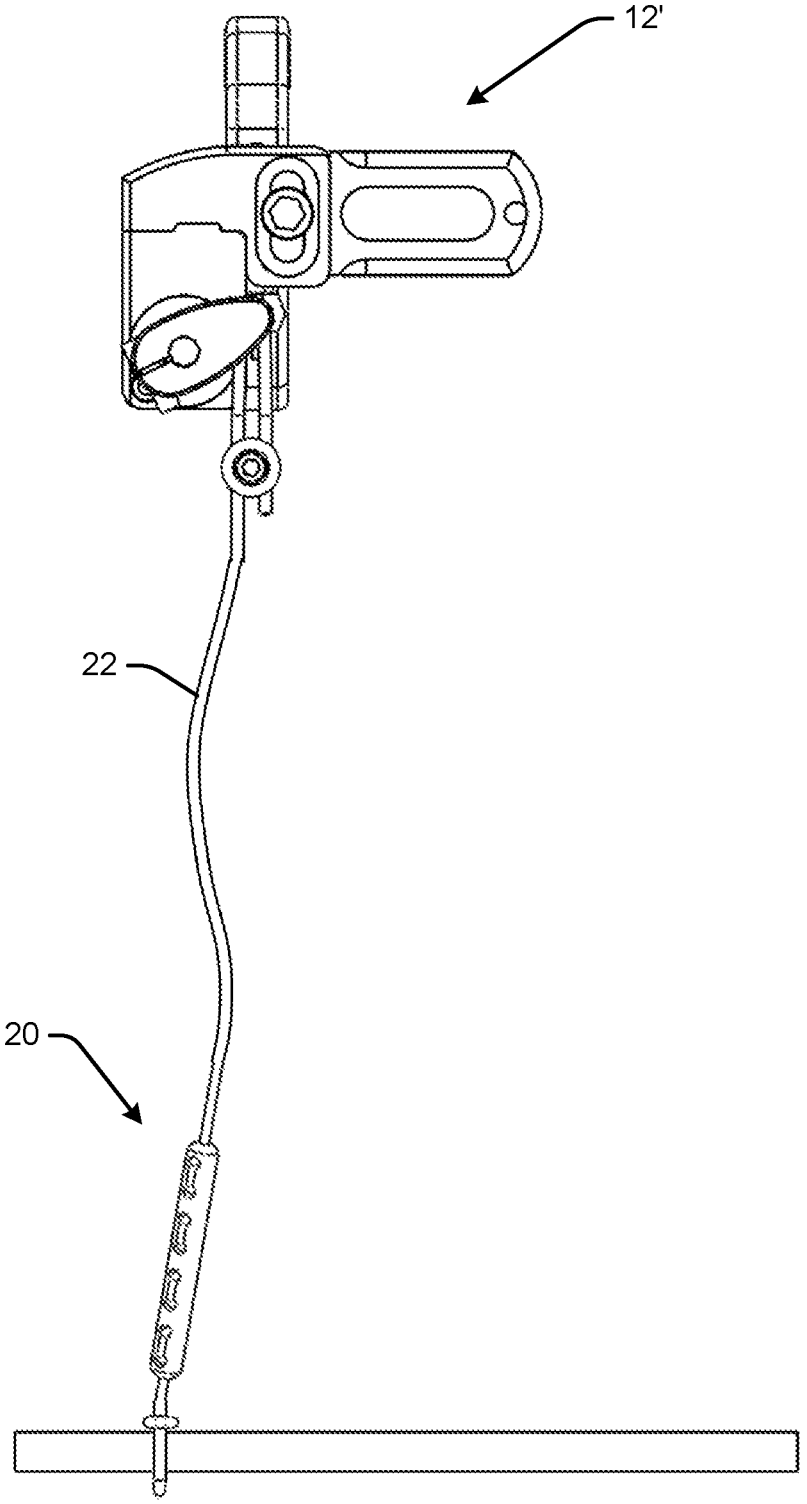
FIGS. 13-14 show the example orthogonal cord force device in a bow system at rest, when the cord is under tension.
Figure 14:
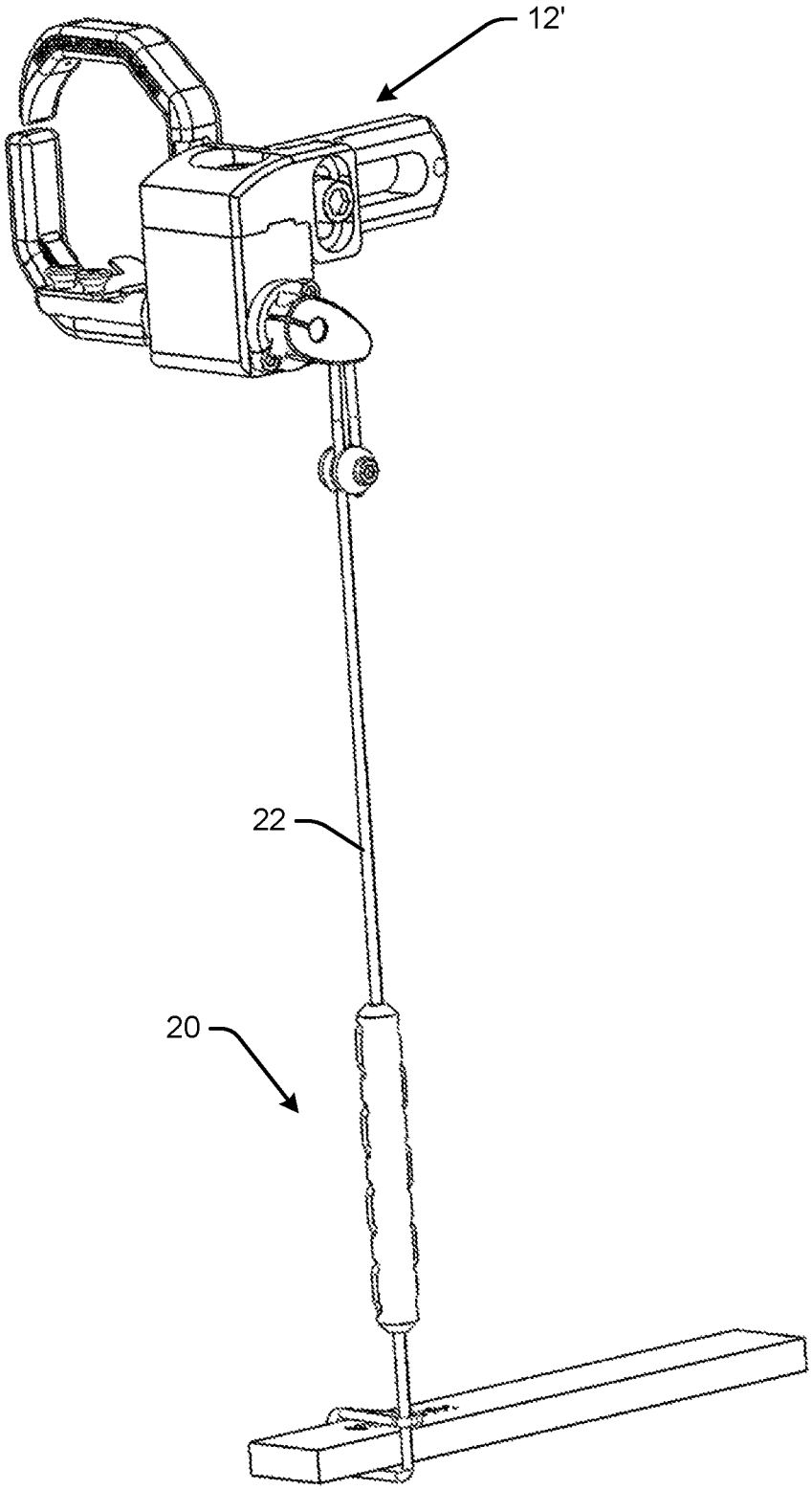
Figure 15:
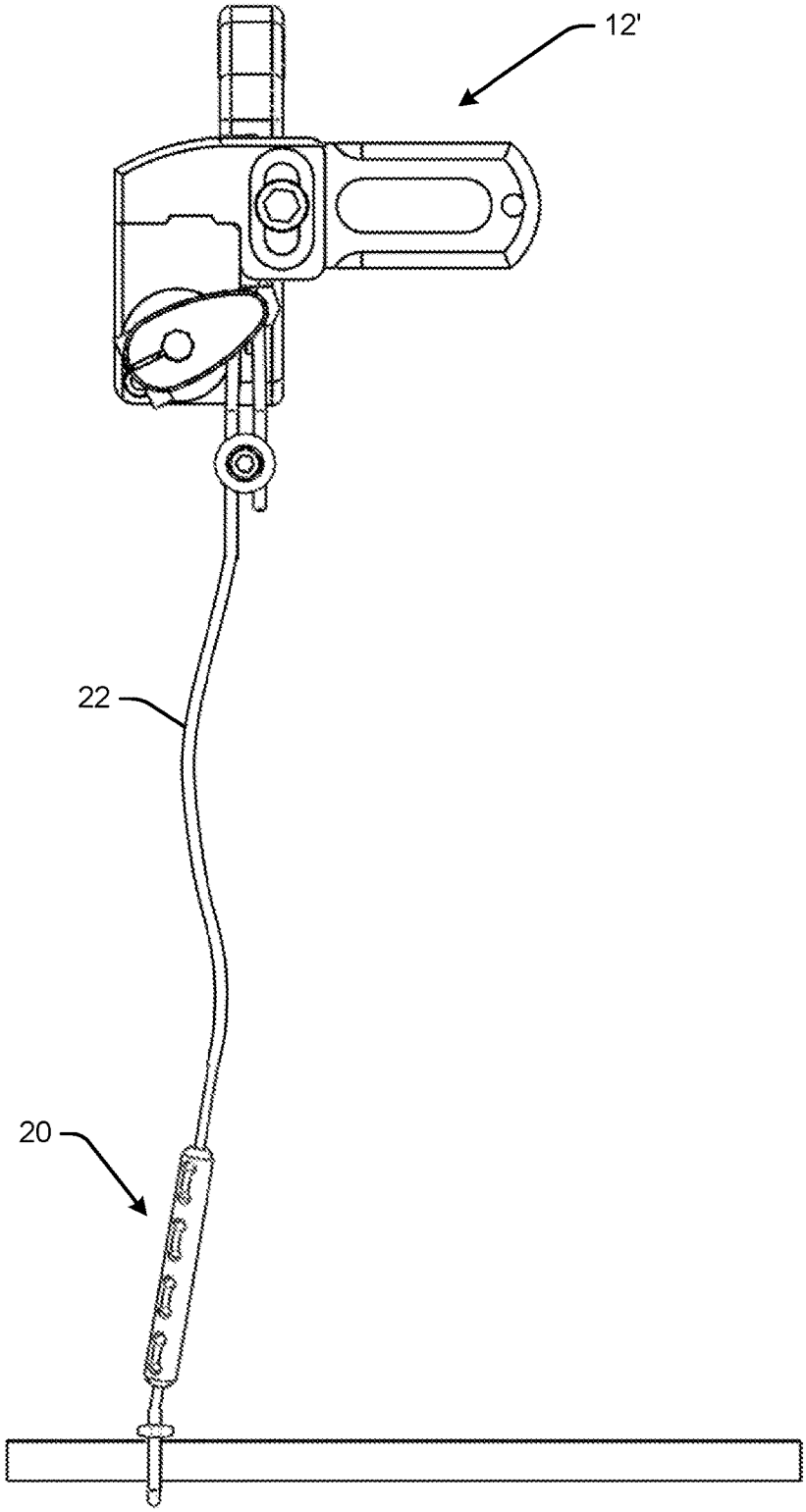
FIG. 15 shows the example orthogonal cord force device in a bow system at full draw, when the cord is not under tension.

FIGS. 13-14 show the example orthogonal cord force device 20 in a bow system at rest, when the cord 22 is under tension. FIG. 15 shows the example orthogonal cord force device 20 in a bow system at full draw, when the cord 22 is not under tension.

When stretched, the effective length of the cord 22 increases with the orthogonal cord force device 20. The force required to overcome the effective spring constant and effective spring rate of the orthogonal cord force device 20 as imparted via the cord 22. The effective spring of the orthogonal cord force device 20 applies a linear force to the cord 22 under tension.

The effective force applied to the cord 22 of an arrow rest as part of an archery bow system to launch a projectile arrow works to straighten the tortuous path of the cord as weaved through the orthogonal cord force device 20. The result is the cord 22 increases in effective length in the axial dimension momentarily, and returns to the original length for a limb actuated rest or a fall-away rest. The cord length change is a function of the axial force imparted on the cord 22 by the bow system as attached through the arrow rest assembly 12' to the bow system. The archery arrow rest orthogonal cord force device 20 applies an equal and opposite force to the cord 22 during these conditions that is orthogonal to the axis of the cord 22, as defined by the two end points of the cord as attached to the arrow rest system 12' and the archery bow system 10.

Figure 16:
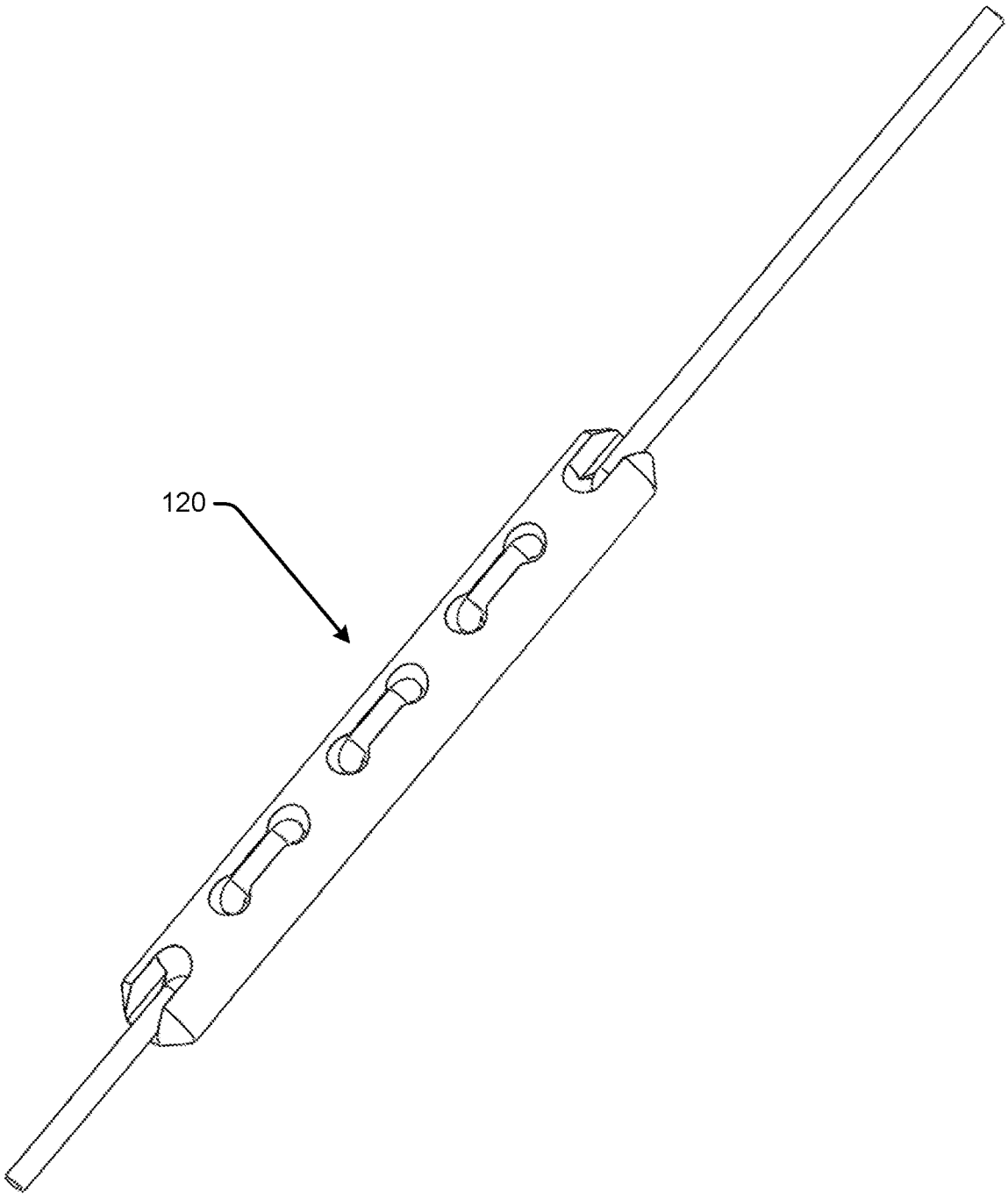
FIG. 16 shows another example orthogonal cord force device.
Figure 17:
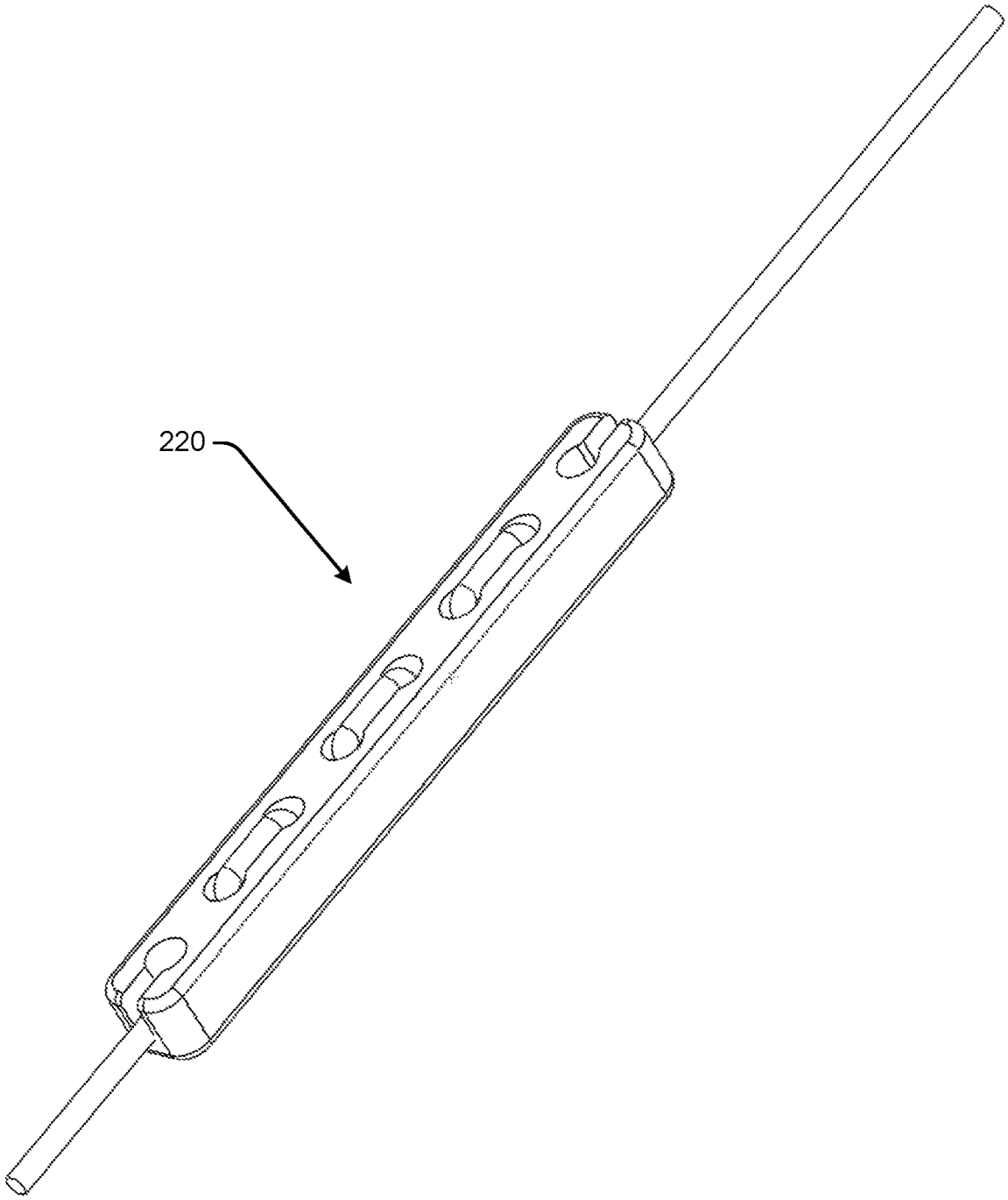
FIG. 17 shows another example orthogonal cord force device.
Figure 18:
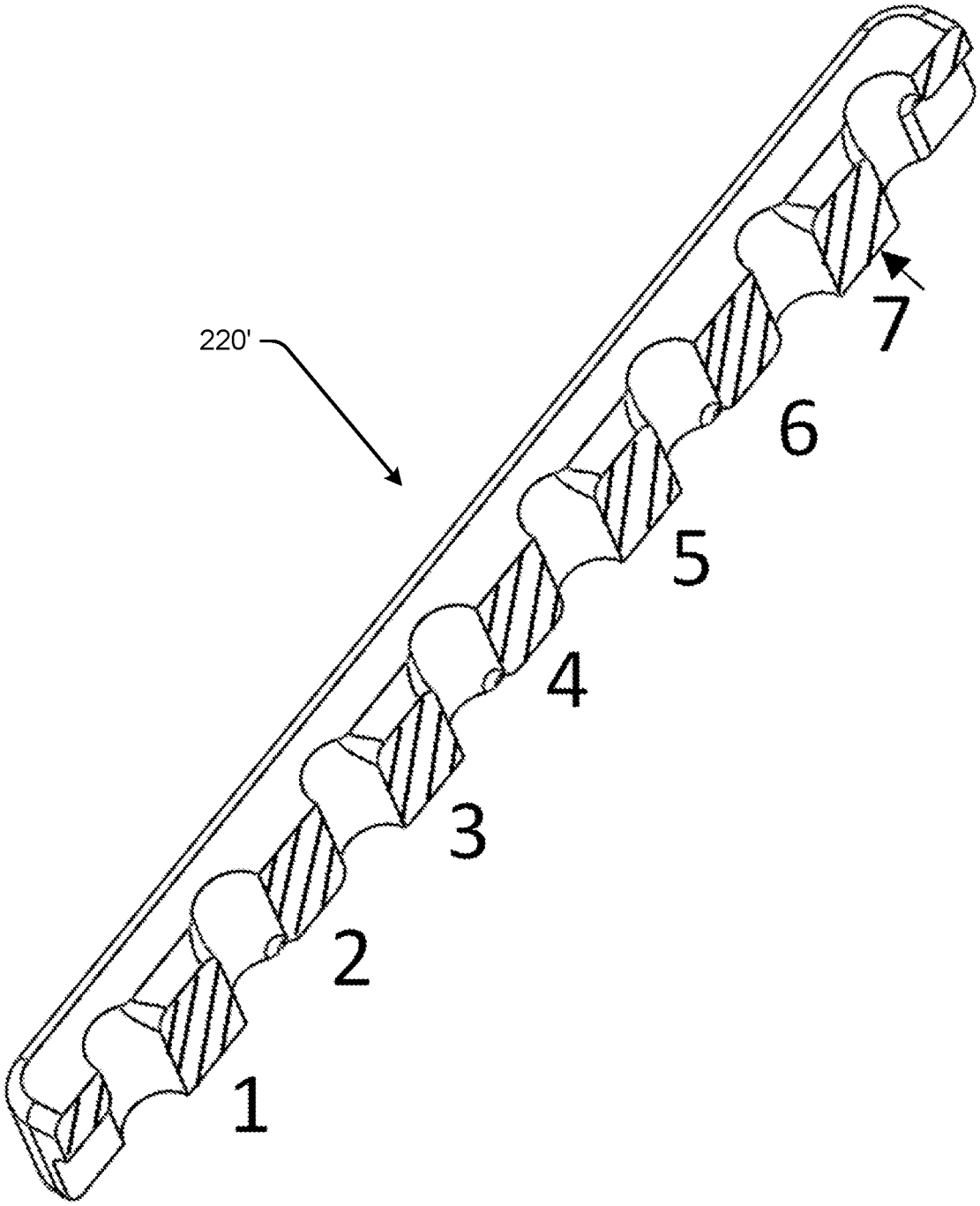
FIG. 18 shows a cross-sectional view of the example orthogonal cord force device corresponding to FIG. 17, configured with seven path elements.
Figure 19:
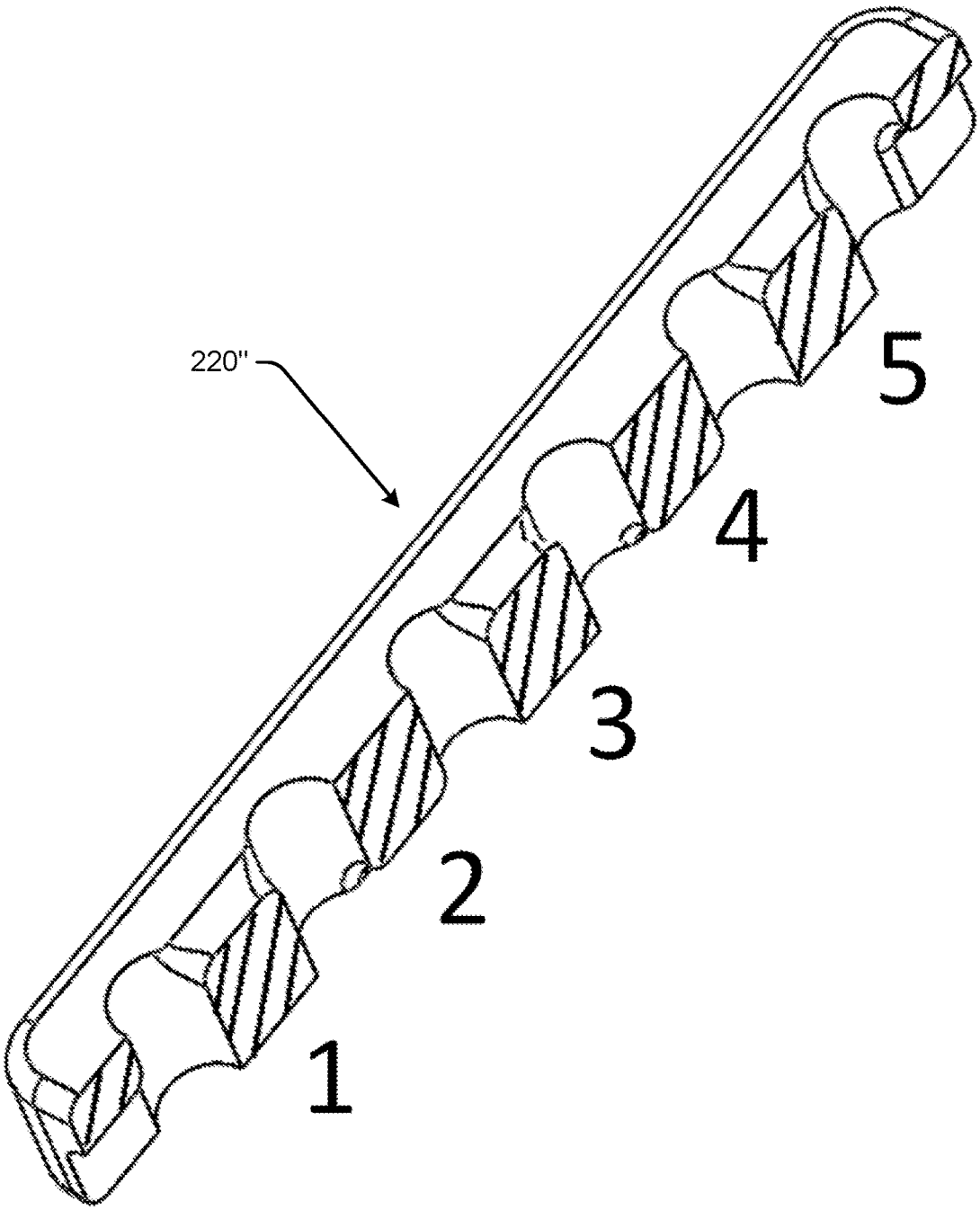
FIG. 19 shows a cross-sectional view of the example orthogonal cord force device corresponding to FIG. 17, configured with five path elements.

FIG. 16 shows another example of an orthogonal cord force device 120. FIG. 17 shows another example of an orthogonal cord force device 220. FIG. 18 shows a cross-sectional view of the example orthogonal cord force device 220' corresponding to FIG. 17, configured with seven path elements of the circuitous path formed within the housing member. FIG. 19 shows a cross-sectional view of the example orthogonal cord force device 220" corresponding to FIG. 17, configured with five path elements.

Figure 20:
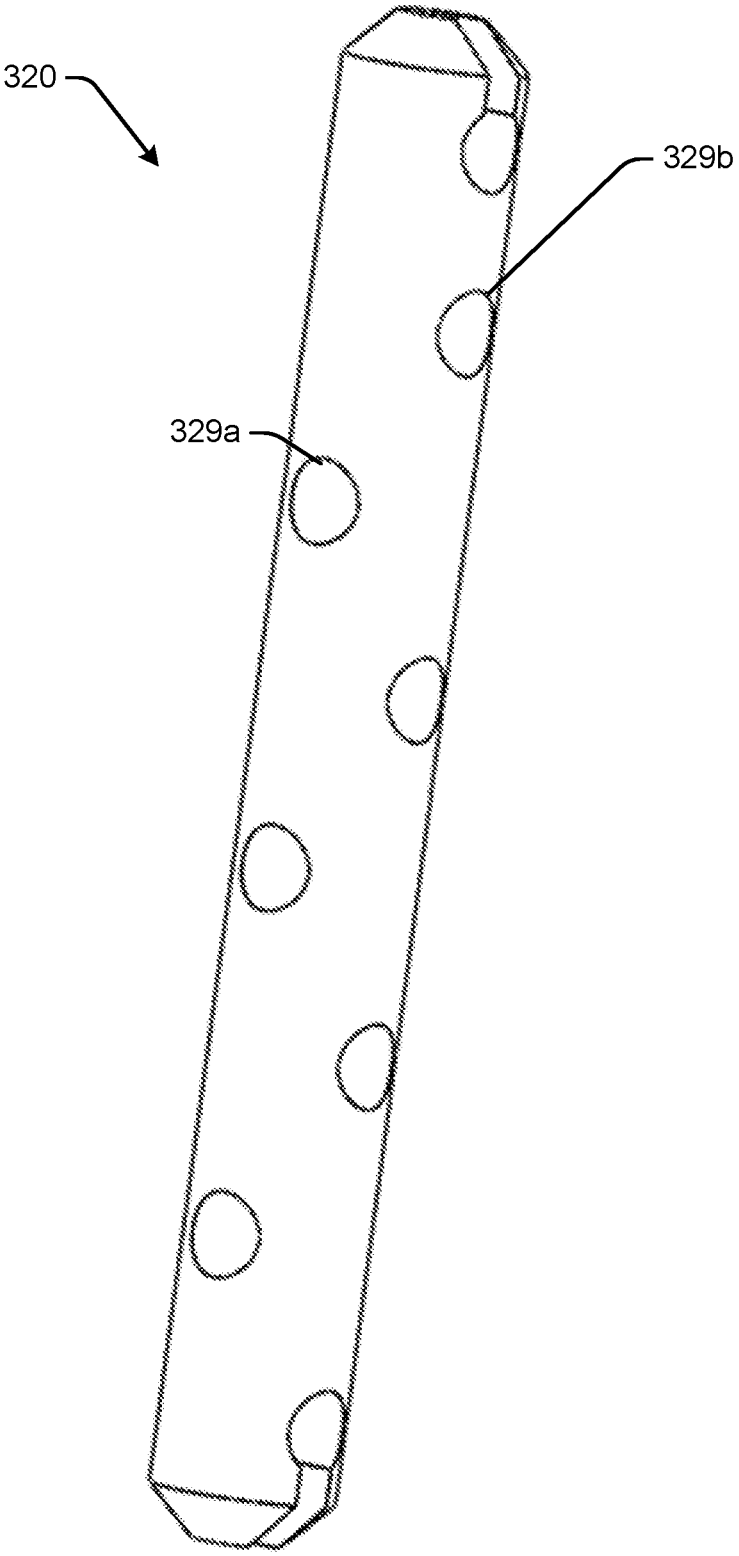
FIG. 20 shows another example orthogonal cord force device having an axially rotational weave pattern.
Figure 21:
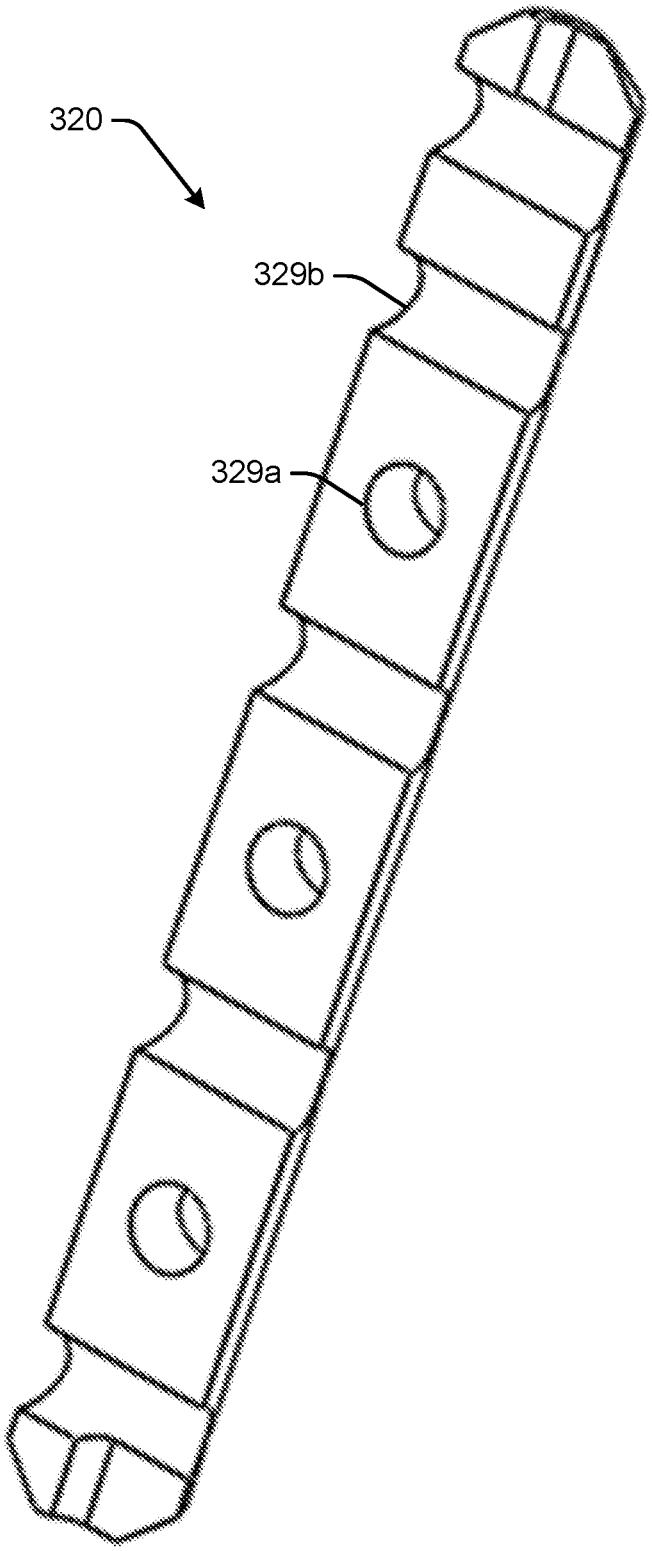
FIGS. 21 and 22 show cross-sectional views corresponding to the orthogonal cord force device having an axially rotational weave pattern of FIG. 20.
Figure 22:
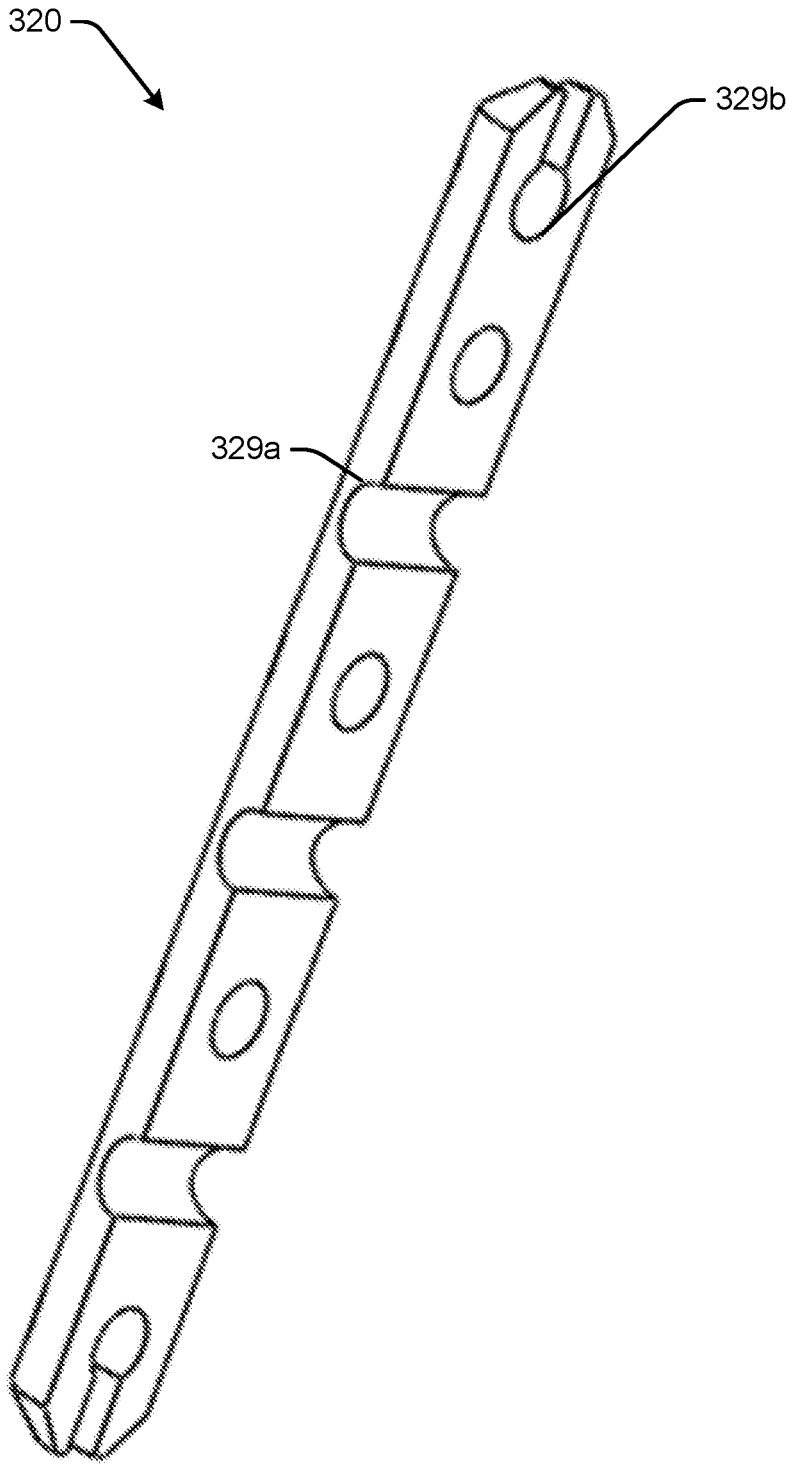

FIG. 20 shows another example of an orthogonal cord force device 320 having an axially rotational weave pattern. FIGS. 21 and 22 show cross-sectional views corresponding to the orthogonal cord force device having an axially rotational weave pattern of FIG. 20. The weave pattern is formed by axial rotation of a plurality of through-holes 329*a* and perpendicularly oriented through-holes 329*b*. The axial rotation (interior to the housing) of the through-holes 329*a-b* may be about 90 degrees apart (as shown), or any other suitable pattern (e.g., every 30 degrees, 45 degrees, 60 degrees) or other internal design to provide the desired change in effective cord length. Still other examples are also contemplated, as will be readily understood by those having ordinary skill in the art after becoming familiar with the teachings herein.

In an example, the increase in cord length accomplished by the orthogonal cord force device, is a function of the number of the cross-sections of the linear weave pattern and angular position about the effective cord length axis between any two adjacent through holes for the cord to be weaved through and/or around portions of the perimeter of the housing. In an example, the housing dimensions are approximately 2" to 4" in length and 0.2 to 0.5" in diameter. The number of sections, the length of the sections (dimensions between through-holes), the relative angular position between any two adjacent though-holes, and the non-deformable compliant material properties of the sections defined to be between any two adjacent through holes (material durometer) as applied orthogonally to the cord, determine the force required to lengthen the cord dimension. As the quantity of sections and angular position between any two though holes increase, the resistive force increases proportionally when the effective cord length is increased. As the angular position between any two through holes is increased, the torsional resistance force about the cord's effective axial length under tension increases as well. The effective length of the cord length is limited by the elastomeric properties of the material (spring constant and spring rate) and/or by physical constraint.

It is noted that the examples shown and described are provided for purposes of illustration and are not intended to be limiting. Still other examples are also contemplated.

The invention claimed is:

1. An archery arrow rest orthogonal cord force device for an arrow rest of an archery bow, comprising:

a housing member having a first end and a second end; and a circuitous path formed at least partly within the housing member, the circuitous path extending at least partly between the first end and the second end of the housing member;

wherein the housing member is attached along a linear axis of a cord defined by two attachment points of the cord in the arrow rest as part of the archery bow.

2. The device of claim 1, further comprising at least one wall in the housing member, the at least one wall forming a portion of the circuitous path.

3. The device of claim 1, further comprising at least one opening through a portion of the housing member, the at least one opening forming a portion of the circuitous path.

4. The device of claim 1, wherein a cord tension (+F, −F) is defined as a linear force exerted between two attachment points of the cord, and wherein an elastomeric force (+Fe, −Fe) on the cord increases as the cord tension (+F, −F) increases.

5. The device of claim 4, wherein the elastomeric force (+Fe, −Fe) applies an orthogonal counter force to the cord when the cord is under tension.

6. The device of claim 4, wherein the elastomeric force (+Fe, −Fe) varies as a function of force applied to the cord.

7. The device of claim 4, wherein the elastomeric force (+Fe, −Fe) is applied orthogonally to the cord along an axis defined by end points of the cord.

8. The device of claim 4, wherein +F is a linear force imparted by a first attachment point.

9. The device of claim 4, wherein −F is a linear force imparted by a second attachment point to a bow member.

10. The device of claim 4, wherein the elastomeric force (+Fe, −Fe) is about zero when there is no force on the cord (+Fchord, −Fchord).

11. The device of claim 10, wherein the elastomeric force (+Fe, −Fe) is substantially equal to the force on the cord (+Fchord, −Fchord) at all times.

12. The device of claim 10, wherein the elastomeric force (+Fe, −Fe) is substantially proportional to the force on the cord (+Fchord, −Fchord) at all times.

13. The device of claim 10, wherein increasing the force on the cord (+Fchord, −Fchord) straightens the cord.

14. The device of claim 10, wherein increasing the force on the cord (+Fchord, −Fchord) increases the cord length.

15. The device of claim 10, wherein decreasing the force on the cord (+Fchord, −Fchord) decreases the cord length.

16. The device of claim 1, wherein the housing member provides a resistance when the cord is under tension.

17. The device of claim 1, wherein the circuitous path increases a length in a linear axial direction of the cord in the arrow rest.

18. The device of claim 1, wherein at least one dimension of the housing member changes when the cord is under tension, and wherein the at least one dimension of the housing member returns back to an original value when the tension on the cord is relieved.

19. The device of claim 18, wherein spring effectiveness of the cord increases when the tension on the cord is relieved.

20. An archery arrow rest orthogonal cord force device for an arrow rest of an archery bow, comprising:

a housing member having a first end and a second end;

a circuitous path formed at least partly within the housing member, the circuitous path extending at least partly between the first end and the second end of the housing member;

at least one wall in the housing member, the at least one wall forming a portion of the circuitous path; and at least one opening through a portion of the housing member, the at least one opening forming a portion of the circuitous path;

wherein the housing member is attached along a linear axis of a cord defined by two attachment points of the cord in the arrow rest as part of the archery bow.

* * * * *